US011761302B2

(12) United States Patent
Krupski et al.

(10) Patent No.: US 11,761,302 B2
(45) Date of Patent: Sep. 19, 2023

(54) APPARATUS AND METHOD FOR CREATING A FLUID COMMUNICATION LINE IN A DOWNHOLE ENVIRONMENT

(71) Applicant: Viking Completion Technology FZCo, Dubai (AE)

(72) Inventors: Bartosz Krupski, Dubai (AE); Colin Scott Boyle, Dubai (AE); Gordon Kenneth Scott, Dubai (AE)

(73) Assignee: VIKING COMPLETION TECHNOLOGY FZCO, Dubai (AE)

( * ) Notice: Subject to any disclaimer, the term of this patent is extended or adjusted under 35 U.S.C. 154(b) by 127 days.

(21) Appl. No.: 17/408,608

(22) Filed: Aug. 23, 2021

(65) Prior Publication Data

US 2022/0065073 A1 Mar. 3, 2022

(30) Foreign Application Priority Data

Aug. 26, 2020 (GB) ..... 2013391

(51) Int. Cl.
*E21B 34/14* (2006.01)
*E21B 23/14* (2006.01)
(Continued)

(52) U.S. Cl.
CPC ..... *E21B 34/14* (2013.01); *E21B 23/14* (2013.01); *E21B 29/06* (2013.01); *E21B 34/063* (2013.01); *E21B 34/10* (2013.01); *E21B 34/106* (2013.01)

(58) Field of Classification Search
CPC ..... E21B 34/14; E21B 23/14; E21B 34/106; E21B 34/063; E21B 29/06; E21B 34/10
See application file for complete search history.

(56) References Cited

U.S. PATENT DOCUMENTS 6,523,614 B2 * 2/2003 Dennistoun ..... E21B 29/08 166/322
7,703,538 B2 * 4/2010 Johnson ..... E21B 17/18 166/55.7

(Continued)

FOREIGN PATENT DOCUMENTS

GB 2287051 A 9/1995

OTHER PUBLICATIONS

Ntellectual Property Office of the UK Patent Office; Search Report for GB2013391.4, claims 1-8; one page; dated Mar. 15, 2021; Intellectual Property Office of the UK Patent Office, Newport, South Wales, United Kingdom.

(Continued)

*Primary Examiner* — Nicole Coy
(74) *Attorney, Agent, or Firm* — LAW OFFICE OF JESSE D. LAMBERT, LLC

(57) ABSTRACT

Method and apparatus for creating a fluid communication line in a downhole environment between an annular chamber and a throughbore of a tool. The tubular wall therebetween is provided with circumferentially arranged recesses extending into the wall to provide selected thin-walled sections for perforation by a communication tool. The communication tool has two oppositely arranged punch heads, one aligned with a recess and the other between neighbouring recesses giving an orientationless configuration in operation. An embodiment for creating a fluid communication line through a tubing retrievable safety valve for operation of a wireline retrievable safety valve located therein is described.

18 Claims, 4 Drawing Sheets

Figure 1A:
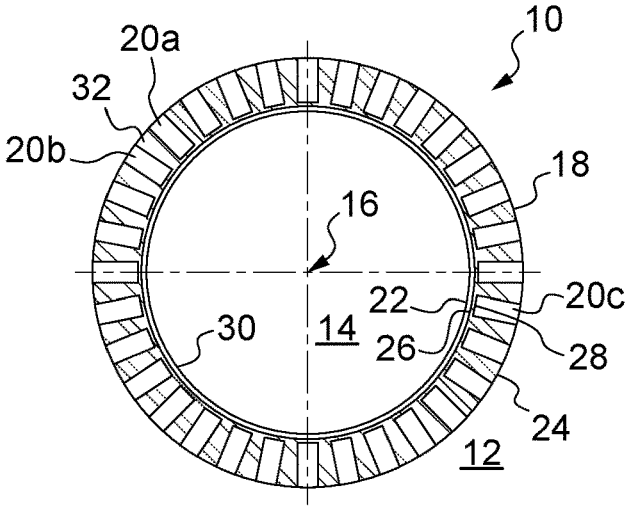

(51) Int. Cl.

| | |
|---|---|
| ***E21B 34/10*** | (2006.01) |
| ***E21B 29/06*** | (2006.01) |
| ***E21B 34/06*** | (2006.01) |

(56) References Cited

U.S. PATENT DOCUMENTS

| | | | | |
|---|---|---|---|---|
| 7,730,949 | B2 * | 6/2010 | Guignard | E21B 34/14 166/55.3 |
| 10,641,063 | B2 * | 5/2020 | Lake | B22F 10/20 |
| 10,808,478 | B2 * | 10/2020 | Goodell | E21B 23/01 |
| 2019/0162037 | A1 | 5/2019 | Duphorne et al. | |

OTHER PUBLICATIONS

Ntellectual Property Office of the UK Patent Office; Search Report for GB2013391.4, claims 9-15; one page; dated Apr. 21, 2021; Intellectual Property Office of the UK Patent Office, Newport, South Wales, United Kingdom.

* cited by examiner

C-C

A-A

B-B

APPARATUS AND METHOD FOR CREATING A FLUID COMMUNICATION LINE IN A DOWNHOLE ENVIRONMENT

The present invention relates to a method and apparatus for creating a fluid communication line in a downhole environment and in particular, though not exclusively, to creating a fluid communication line through a tubing retrievable safety valve for operation of a wireline retrievable safety valve located therein in a well.

Many downhole tools are hydraulically operated by fluid from the surface of the well. This may be pumped down the bore of the well or delivered via a dedicated control line from the surface to the tool. One such tool which must be operated by a control line is a subsurface safety valve. Subsurface safety valves are incorporated within the well structure to protect against high pressure and high temperature formation fluids from travelling unimpeded to the surface during operations. Such tubing retrievable safety valves (TRSV) are built into the tubing string and have a valve, typically flapper or ball, held open by the action of a piston which is maintained in position by hydraulic fluid pressure from the control line. If hydraulic fluid pressure is lost, the TRSV will immediately close, preventing passage of the production fluids through the tubing to the surface, in response to identification of abnormal or potentially dangerous conditions.

It is common for the TRSV to be subjected to many years of operation, often in severe conditions and therefore it is not unusual for the TRSV to fail, or, due to wear and tear, the TRSV will lose its ability to close or open properly. The risk of danger which could arise should the TRSV malfunction is sufficiently high that it is of great importance that any damaged or malfunctioning TRSV should be replaced or repaired promptly.

The integration of the TRSV in the tubing structure means that historically, removal of the tubing string to replace or repair a malfunctioning valve was essential. However, removal of a tubing string section and subsequent repair or replacement is a costly and time consuming process.

To overcome the expense and time delays caused by removal of a section of a tubing string, use of wireline retrievable safety valves (WRSV) has been developed. The WRSV can be inserted into the original TRSV and operated to provide the same safety function as the original TRSV. The original valve mechanism in the TRSV must be locked open and the WRSV must connect to the hydraulic control line. In this way, once the WRSV is in place within the TRSV, the WRSV will be operated by hydraulic fluid pressure communicated thereto from surface through the hydraulic fluid control line and through the TRSV.

A known approach to establishing fluid communication between the TRSV and the WRSV is to design an annular chamber in the TRSV in the hydraulic fluid path. The annular chamber is in a control housing which is formed in a separate sub made up into the body of the valve between the top sub and the spring housing used to control the piston. The annular hydraulic chamber has an inner tubular wall to the throughbore of the TRSV. When a WRSV is to be installed a communication tool is located in the TRSV which forms one or more apertures through the inner wall to the annular chamber, typically by punching holes through the inner wall. The WRSV is then located within the TRSV and uses this fluid communication path to access and be controlled from the hydraulic fluid line.

However, in order to ensure that the inner wall of the annular chamber can be punched through, the thickness of the inner wall is thinned around the circumference thereof. As high pressure can exist in the throughbore, the thinned inner wall means that the pressure in the hydraulic line and annular chamber must be kept high to maintain a balance. If the pressure balance is lost, the wall can buckle causing failure of the valve. The thinned inner wall also decreases the tensile loading which can be applied through the valve body, particularly as one or more holes are punched through the inner wall. In order to maintain sufficient tensile load through the valve body, an over body is used which increases the number of separate parts in the valve and consequently, the number of seals needed between the parts. With the control housing as a separate sub made up into the body of the valve between the top sub and the spring housing, the multiple seals disadvantageously provide multiple potential leak paths to the hydraulic fluid path through the valve during its operation in the well.

It is therefore an object of the present invention to provide apparatus for creating a fluid communication line in a downhole environment which obviates or mitigates at least some of the disadvantages of the prior art.

It is a further object of the present invention to provide a method for creating a fluid communication line in a downhole environment which obviates or mitigates at least some of the disadvantages of the prior art.

According to a first aspect of the present invention there is provided apparatus for creating a fluid communication line in a downhole environment between an annular chamber and a throughbore, the throughbore having a central longitudinal axis, there being a tubular wall between the annular chamber and the throughbore, and wherein the tubular wall is provided with a circumferentially arranged plurality of recesses, extending into the wall.

In this way, the wall thickness in a recess is thinner than a wall thickness surrounding a recess. This provides a number of thin walled areas able to be perforated to allow fluid communication whilst still allowing sufficient full thickness wall around the recesses to ensure the wall is able to reasonably stand significant hydraulic pressures whilst also facilitating ease of perforation. By maintaining the mechanical integrity of the wall across the annular chamber, a separate sub is not required between the top sub and piston housing in a TRSV which removes leak paths from the throughbore. A control housing in the form of a sleeve can be mounted over the main body, with the main body including the tubular wall and thus the control housing is totally independent of the main valve body to maintain its mechanical integrity. Such a control housing also removes two body connections from the valve and greatly shortens its length.

Preferably, the recesses extend from an outer surface of the wall so that they access the annular chamber. In this way, the thin-walled sections are closest to the bore so that a punch only has to travel a short distance into the wall to break through a thin-walled section.

Preferably, the recesses are arranged equidistantly around the tubular wall. More preferably, the recesses cover a majority of a circumference of the tubular wall. In this way, a majority of the surface area of the tubular wall over the circumference is thin-walled, providing a greater area through which to punch through.

Preferably, the recesses are identical in size and shape. More preferably, the recesses are cylindrical providing a circular disc of a first thickness. The tubular wall may have a second thickness in which the recesses are formed, the second thickness being greater than the first thickness.

Preferably, the recesses are arranged radially from the central longitudinal axis. In the way, the recesses lie on a plane which is perpendicular to the central longitudinal axis. This provides an angular radial separation between recesses. There may be an odd number of recesses or there may be an even number of recesses. In this way, it can be arranged so that pairs of recesses face each other across a diameter of the throughbore or each recess faces a thick walled section between recesses.

Preferably, the tubular wall and plurality of recesses form part of a main body of a tubing retrievable safety valve. In this way, the mechanical integrity of the tubular wall across the annular chamber of a TRSV is maintained, a separate sub including the tubular wall and recesses is not required. Preferably a control housing in the form of a sleeve is located over the main body so as to form the annular chamber and provide a control line connection. In this way, seals between the control housing and main body are not exposed to well fluids in the throughbore and thus critical leak paths are removed.

According to a second aspect of the present invention there is provided a communication tool to create a fluid communication line in apparatus according to the first aspect, the tool comprising a punch mechanism configured to radially extend a punch head so as to perforate the tubular wall between the annular chamber and the throughbore to provide the fluid communication, the tool being characterised in that: there are two punch heads, the punch heads being arranged to extend radially from the central longitudinal axis, in use, opposite each other with a first punch head aligned with a recess and a second punch head aligned with the tubular wall between two neighbouring recesses.

In this way, regardless of the orientation of the communication tool in the throughbore, at least one hole will be punched/perforated through a recess to provide the fluid communication.

Preferably, the first and the second punch heads lie on a transverse axis perpendicular to the central longitudinal axis across a diameter of the throughbore. In this way, when an odd number of recesses are formed in the tubular wall and spaced equidistantly around the tubular wall, at least one recess will be perforated when the punch mechanism is operated.

More preferably, the first punch heads lies on a transverse axis perpendicular to the central longitudinal axis across a diameter of the throughbore and the second punch lies at an angle offset from the transverse axis, the angle being equal to half the radial separation between the recesses. In this way, when an even number of recesses are formed in the tubular wall and spaced equidistantly around the tubular wall, at least one recess will be perforated when the punch mechanism is operated.

Preferably, the first and second punch heads are operated independently. In this way, when a punch head meets the thick section of tubular wall between the recesses and stops, the other punch head is free to perforate the thin wall at the recess to create the fluid communication path.

The punch mechanism may be hydraulically actuated. The punch mechanism may be a piston mechanism. Preferably there are two pistons, one associated with each punch head. Each punch head may be retained in position within the tool by a shear pin prior to actuation. Each shear pin shears allows each punch head remain within position during deployment but then to be pushed onwards upon actuation.

Preferably, the punch mechanism includes retraction means to move the punch heads radially inwards when the communication tool is removed from the apparatus. In this way, the communication tool is prevented from being stuck in the apparatus after the punch mechanism is operated.

Each punch head may be provided with a lead face which engages with the thinned wall and recess. Each lead face may be provided with a point. A pointed lead face will assist in effective perforation of the tubular wall.

Each lead face may taper to a point. A tapered point lead face will assist in opening a suitable broad perforation to allow effective hydraulic communication as well as to assist in orientating the punch head fully within the recess if a true engagement is achieved initially. Each lead face tapered point may be provided with a recess. Provision of a recess in the tapered point will assist in the moving of any debris from the perforation of the wall in order to minimize potential blockage of the perforation and provide a clean through hole for fluid communication to occur.

According to a third aspect of the present invention there is provided a method for creating a fluid communication line in a downhole environment, comprising the steps:

(a) running a communication tool according to the second aspect into a well;

(b) locating the communication tool in apparatus according to the first aspect in the well, the punch heads being at the same depth as the recesses;

(c) operating the punch mechanism so as to radially extend the punch heads; and (d) perforating the tubular wall at a recess to provide fluid communication through the tubular wall.

In this way, a guaranteed fluid communication route is established through the tubular wall of the annular chamber without the requirement to provide a fixed orientation on the communication tool.

Preferably, in step (b) a ledge on the communication tool lands on shelf on a wall of the throughbore of the apparatus to stop the communication tool with the punch heads aligned with the recesses. In this way, no orientation of the communication tool is required on run-in.

Preferably, the apparatus is a tubing retrievable safety valve and the method includes the further step of running in a wireline retrievable safety valve into the tubing retrievable safety valve and operating the wireline retrievable safety valve via the communication line created at the perforated recess.

Preferably the communication tool is run-in on wireline. This simplifies the method.

Preferably, at step (c) the punch mechanism is operated by pumping fluid downhole.

Figure 1B:
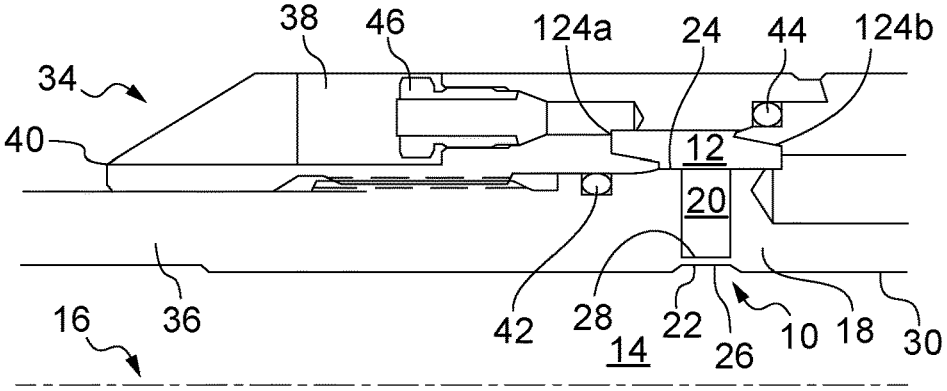
Figure 5A:
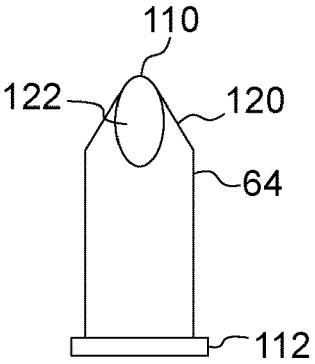
Figure 5B:
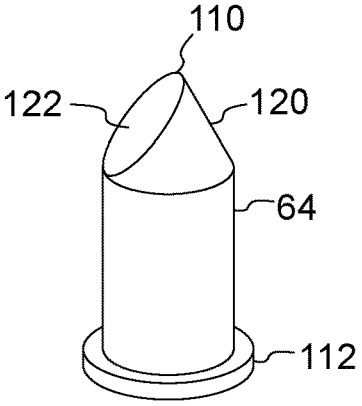
Figure 2:
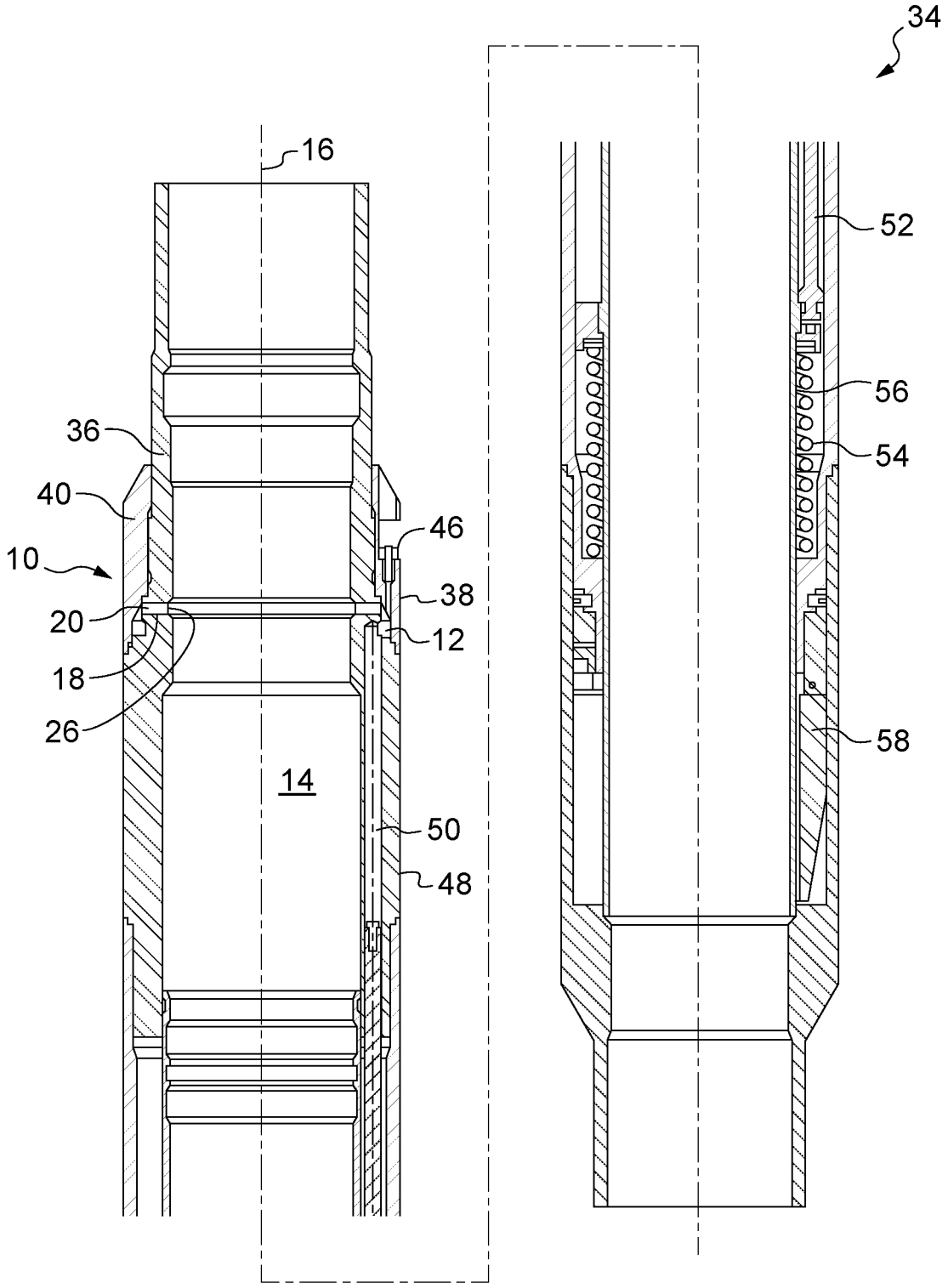
Figure 3B:
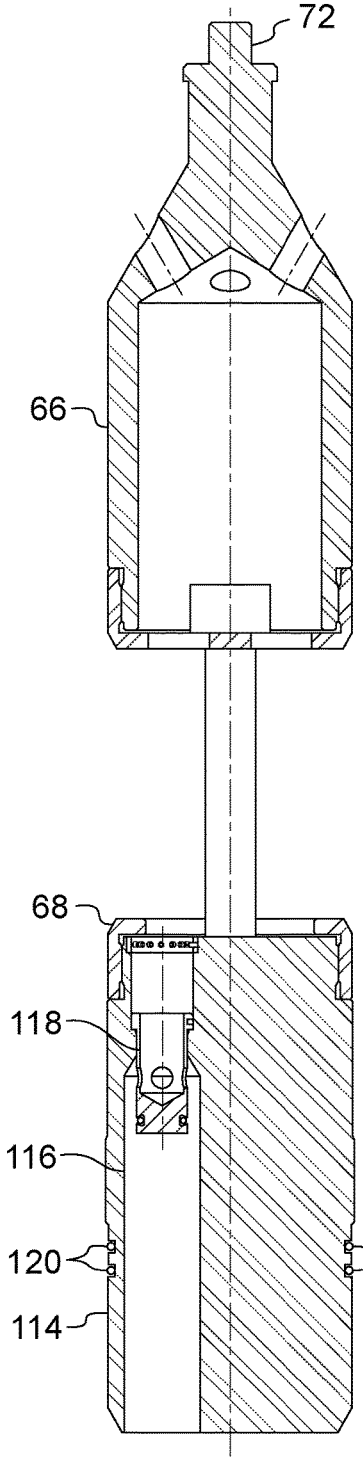
Figure 3A:
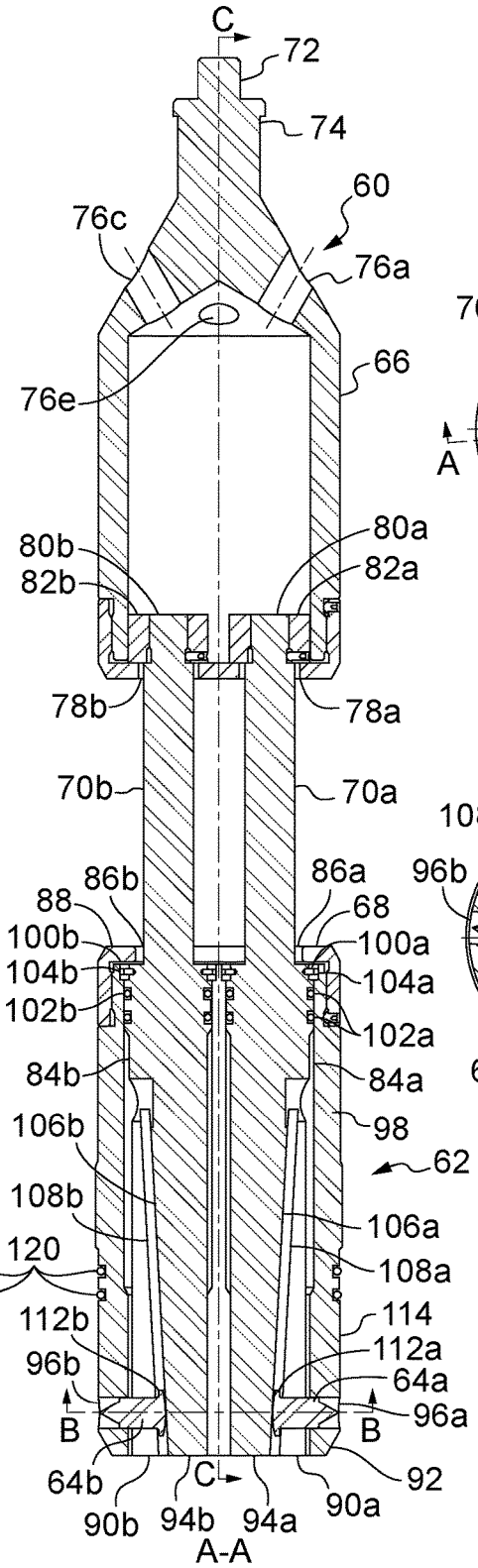
Figure 3C:
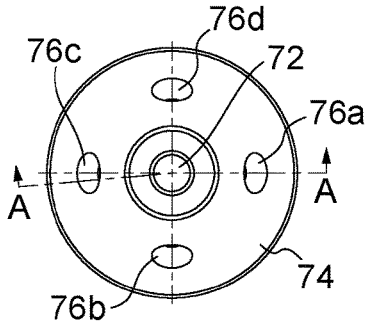
Figure 3D:
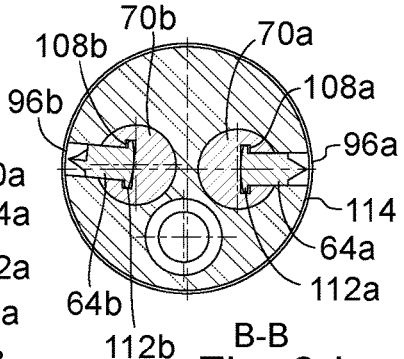
Figures 4A, 4B:
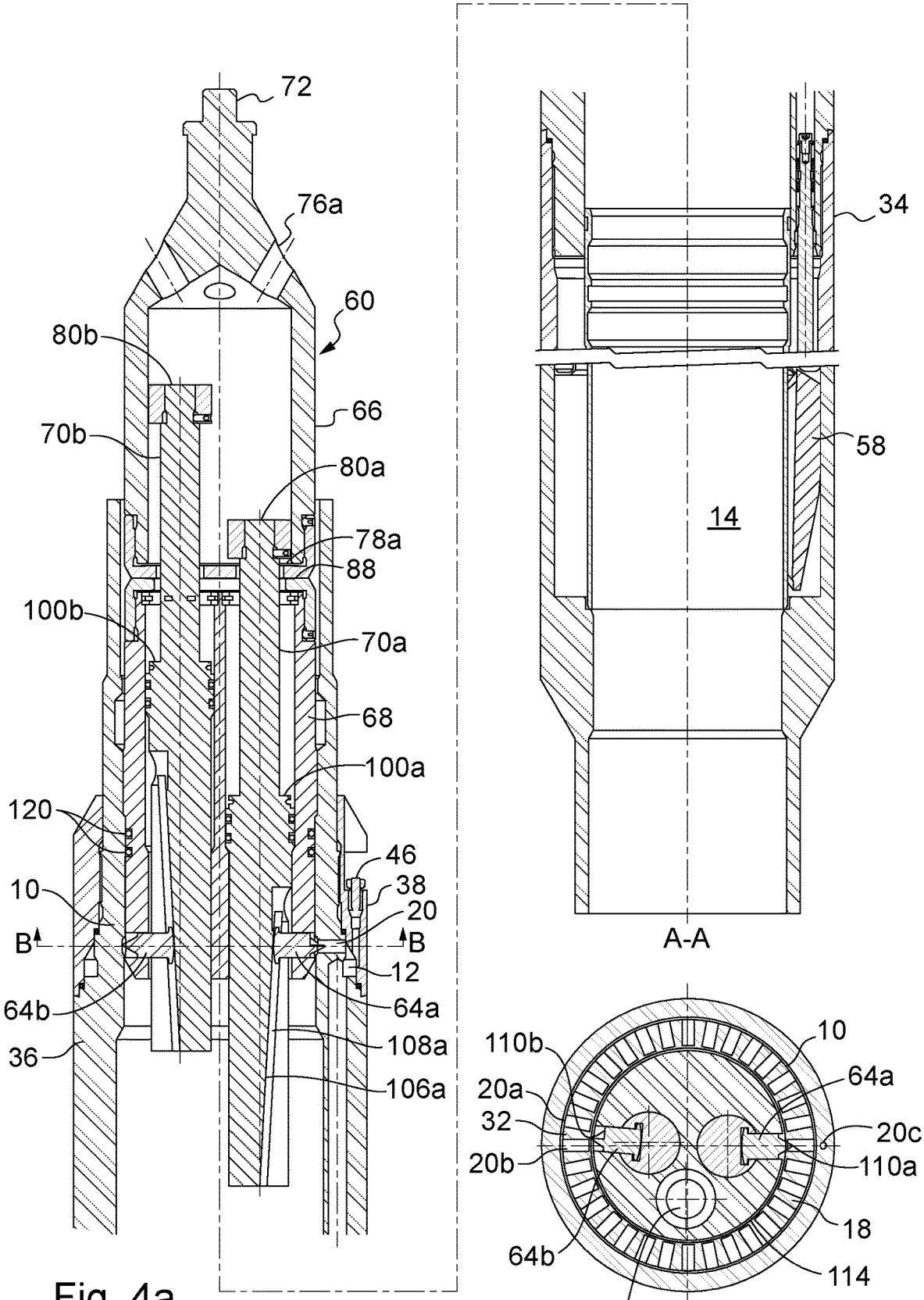

Embodiments of the present invention will now be described with reference to the following figures, by way of example only, in which:

FIGS. 1(*a*) and 1(*b*) are cross-sectional views through (a) apparatus in a (b) tool according to an embodiment of the present invention;

FIG. 2 is a cross sectional view through a tubing retrievable safety valve including the apparatus of FIG. 1(*a*) according to an embodiment of the present invention;

FIGS. 3(*a*)-(*d*) show (a), (b), (d) cross sectional and (c) top views through a communication tool according to an embodiment of the present invention;

FIGS. 4(*a*) and 4(*b*) show cross sectional views of the communication tool of FIGS. 3(*a*)-(*d*) within the valve of FIG. 2; and FIGS. 5(*a*) and 5(*b*) are illustrations of a punch head for use in a communication tool according to an embodiment of the present invention.

Reference is initially made to FIGS. 1(*a*) and 1(*b*) of the drawings which illustrates apparatus, generally indicated by reference numeral 10, for creating a fluid communication line in a downhole environment between an annular chamber 12 and a throughbore 14, the throughbore 14 having a central longitudinal axis 16, there being a tubular wall 18 between the annular chamber 12 and the throughbore 14, and the tubular wall 18 is provided with a circumferentially arranged plurality of recesses 20, extending into the wall 18, according to an embodiment of the present invention.

The annular chamber 12 is in communication with the recesses 20 which are formed circumferentially around tubular wall 18 with an area of thin tubular wall 22 corresponding to each recess 20. The annular wall 18 is typically formed of steel and each recess 20 will be machined as a cylindrical bore from an outer surface 24 of the wall 18, radially inwardly with respect to the central axis 16. Each recess 20 will have a depth less than the thickness of the annular wall 18. This will leave a thin-walled section 26 of a first thickness at the base 28 of each recess 20. The inner surface 30 of the annular wall 18 remains as a continuous cylindrical body with no apertures therethrough. This arrangement of recesses 20 is in contrast to prior art arrangements in which an area of thin tubular wall 22 is provided around the entire circumference of the wall 18. In the present invention, between neighbouring recesses 20*a*,20*b*, there remains a section 32 of wall 18 which is of full thickness, considered as a second thickness. The second thickness is much greater than the first thickness so that a punch can travel easily through the thin-walled section 26 at any recess 20. The recesses 20 are spaced equidistantly around the circumference of the annular wall 18 and may be of an even or odd number. In the example, there are thirty two recesses 20, but the number chosen and the dimensions of the recesses 20 may be selected based on the diameter of tubular wall 18, the axial loads expected on the wall and the size of the punch which is intended to be used. By maintaining equidistantly spaced sections 32 of the second thickness, the axial load bearing capacity through the tubular wall 18 when in use downhole is maintained and greatly increased over the prior art arrangements. Additionally, as a significant portion of the tubular wall 18 remains at the location of the recesses 20 and surrounds each recess 20, the full durability of the structure remains meaning the tubular wall 18 is less vulnerable to buckling or collapsing should fluid pressure vary greatly between the annular chamber 12 and the throughbore 14.

The description which follows is with reference to a tubing retrievable safety valve (TRSV) 34, but could apply to any tool arranged in a wellbore. Apparatus 10 can be integral in the main body 36 of any tool arrangement having a central throughbore 14, as illustrated in FIG. 1(*b*). Accordingly, a housing 38 in the form of a tubular sleeve 40 can be located over the main body 36 to create the annular chamber 12. Annular seals 42,44 provided outside the main body 36, isolate the chamber 12 and remove any leak paths from the throughbore 14 to the outer surface 24 of the main body 36. Thus the housing 38 is totally independent of the main valve body 36 mechanical integrity.

With reference to FIG. 2, there is shown a cross section of a TRSV 34, with like parts to those of the earlier Figures given the same reference numerals to aid clarity. The TRSV 34 includes the control housing 38 enclosing the annular chamber 12, with the annular wall 18 and apparatus 10 providing recesses 20, as for FIG. 1. There is a fluid control line fitting 46 at an upper side of the chamber 12 through which high pressure fluid is delivered from surface to operate the valve 34. Between the main body 36 and an outer body 48 there is a piston bore 50 which houses a piston 52 arranged to operate against a spring housing 56 and the bias of a spring 54 therein. The spring housing 56 holds a flapper valve 58 within the body of the valve 34 to provide a clear through bore 14. In use, the pressurised hydraulic fluid in the control line enters the chamber 12 and acts to keep the piston 52 against the spring housing 56 so that the flapper valve 48 is arranged axially and the valve 34 is open. To operate the valve 34, control line fluid pressure is removed. Spring 54 in housing 56 moves the piston 52 upwards which also moves the spring housing 56 upwards to expose the flapper valve 58. The flapper valve 58 is hinged so as to move across and block the throughbore 14 to close the valve 34. This prevents fluids travelling from the well to the surface.

It is noted that the apparatus 10 within the tubular wall 18 of the main body 36 plays no role in the operation of the valve 34. However, its structural integrity via the sections 32 between the recesses 20 assist in taking the axial load through the main body 36. Additionally, by creating the control housing 38 as a sleeve 40 rather than a sub, the amount of connections and therefore potential leak paths through the valve 34 is reduced while the overall length of the valve 34 is also advantageously shortened.

If the TRSV 34 requires to be repaired or replaced, a wireline retrievable safety valve (WRVS) (not shown) can be inserted into the TRSV 34. The WRVS is operated using the original control line and hydraulic fluid fitting 46. In order to use the hydraulic fluid at the fitting 46, access to the annular chamber 12 is required. This is achieved by punching through a thin-walled section 26 in the apparatus 10 of the tubular wall 12. In the prior art, the punch could be positioned at any point around the circumference and it would be opposite a thin-walled area 22, however for the present invention, punching at a recess 20 needs to take place. This is achieved using a communication tool according to an embodiment of the present invention.

Reference is now made to FIGS. 3(*a*) to (*d*) of the drawings which illustrates a communication tool, generally indicated by reference numeral 60, the tool 60 comprising a punch mechanism 62 configured to radially extend two punch heads 64*a,b* so as to perforate the tubular wall 18 between the annular chamber 12 and the throughbore 14 to provide the fluid communication, the punch heads 64*a,b* being arranged to extend radially from the central longitudinal axis 16, in use, opposite each other with a first punch head 64*a* aligned with a recess 20 and a second punch head 64*b* aligned with the tubular wall 18 section 32 between two neighbouring recesses 20*a,b*, as shown on FIG. 4(*b*).

The tool 60 comprises a drive housing 66 and a punch housing 68 being connected via a piston 70*a,b*, one for each punch mechanism 62. The drive housing 66 has a tubular body with a connector 72 at the top 74 for connection to a wireline (not shown) or other conveyancing means to lower the tool 60 into the well. Also in the top 74 are apertures 76*a,d* which allow fluid to pass into and out of the drive housing 66. While four apertures 76*a,d* are shown there may be any number or, alternatively there could be no apertures and the connector 72 could provide a fluid line to surface. At the opposite end of the drive housing 66 from the connector 72, there are two piston shaft outlets 78*a,b* through which the pistons 70*a,b* of punch mechanism 62 extend respectively. First ends 80*a,b* of the pistons 70*a,b* are movably retained in the housing 66 by mounts 82*a,b* respectively.

Each piston 70*a,b* extends from drive housing 66 to the punch housing 68. Punch housing 68 is formed of a substantially cylindrical housing body having two piston housings 84*a,b* formed longitudinally therethrough. Inlets 86*a,b* to the piston housing 84*a,b* are formed at a first end 88 of the punch housing 68; similarly, outlets 90*a,b* are formed at a second end 92 of the punch housing 68, through which lower ends 94*a,b* of the pistons 70*a,b* can exit the punch housing 68. Two punch head outlets 96*a,b* are formed in the cylindrical wall 98 of the punch housing towards the second end 92 thereof and provide access to each piston housing 84*a,b* respectively. As can be seen in FIG. 3(*d*), the outlets 96*a,b* are arranged to extend radially in directions which are almost in direct opposition to one another but at an obtuse angle which is close to, but marginally less than, 180 degrees.

Each piston 70*a,d* has an elongate body which, in this case, is a substantially cylindrical rod, with each having an extended diameter to form a circumferential upward facing ledge 100*a,b*. This ledge 100*a,b* is arranged to abut the inner surface of the punch housing 68 at the inlets 86*a,b* so that the punch housing 68 can be supported on the pistons 70*a,b*. The body of each piston 70*a,b* at the ledge 100*a,b* is sized to the piston housing 84*a,b* so that each piston 70*a,b* is sealed, by o-rings 102*a,b* or the like, to its respective housing 84*a,b*. Shear screws 104*a,b* or other temporary fixings are also present to hold the pistons 70*a,b* in position within the piston housings 84*a,b* when the tool 60 is constructed.

Below the ledge 100*a,b* on each piston 70*a,b*, the body of each piston 70*a,b* asymmetrically tapers towards the lower end 94*a,b*. At the tapered side 106*a,b* a longitudinally extending track 108*a,b* is provided arranged at an angle to the central axis 16.

Each punch head 64*a,b* is formed as a cylindrical body having a point 110*a,b* at a first end and an extended diameter planar base 112*a,b* at the opposing end. The diameter of the base 112*a,b* is sized to locate within and be retained within the track 108*a,b* on each piston 70*a,b*. The diameter of the cylindrical body of each punch head 64*a,b* is sized to fit in the respective punch head outlet 96*a,b*. As can be seen in FIG. 3(*a*), the components are configured such that when the ledge 100*a,b* of each piston 70*a,b* is at the inlets 86*a,b*, the punch heads 64*a,b* sit in the tracks 108*a,b* and orientate the tapered sides 106*a,b* of the pistons 70*a,b* towards the punch head outlets 96*a,b* as the punch heads 64*a,b* extend into the punch head outlets 96*a,b* without protruding from the outer surface 114 of the cylindrical wall 98. Radial movement of the punch heads 64*a,b* is controlled by the longitudinal position of each piston 70*a,b* as the base 112*a,b* of each punch head 64*a,b* is held within the respective track 108*a,b*. As the pistons 70*a,b* are not connected, they can move independently and thus the punch heads 64*a,b* can also move independently of each other.

There is a further shaft 116 arranged longitudinally through the punch housing 68. Shaft 116 includes a valve 118 to allow for pressure equalisation and release across the punch housing 68. This is required as seals 120 are provided on the outer surface 114 of the punch housing 68 and the diameter of the punch housing 68 is sized to seal within the apparatus 10, in use.

We now refer to FIGS. 4(*a*) and 4(*b*) to describe a method for creating a fluid communication line in a downhole environment, according to an embodiment of the present invention. Like parts to those in earlier Figures have been given the same reference numeral, to aid clarity.

Apparatus 10 is typically formed integrally in a downhole tool located in a wellbore. As an example only, FIG. 4(*a*) illustrates the apparatus 10 in a TRSV 34 as described herein with reference to FIGS. 1 and 2. Although not shown, the TRSV 34 will be located in production tubing of a completion in a wellbore. To create the fluid communication line, the communication tool 60 is run into the wellbore. Tool 60 is run in on wireline via connector 72 and will be run in in the configuration shown in FIG. 3. In this regard, the pistons 70*a,b* support the punch housing 68 which in turn are supported by the drive housing 66. The pistons 70*a,b* sit entirely within the punch housing 68 and the punch heads 64*a,b* and held radially inwards within the outlets 96*a,b* of punch housing 68 also. The pistons 70*a,b* are held in place by the shear pins 104.

The communication tool 60 is inserted in the throughbore 14 of the valve 34 and travels therethrough until it is stopped by reaching a nipple, stop-go, ledge or other mating surface in the throughbore 14 of the valve 34. The punch housing 68 is then held in place at a position where the punch heads 64*a,b* are at the same depth and in axial alignment with the recesses 20 of the apparatus 10. As shown in cross-section B-B in FIG. 4(*b*), the punch heads 64*a,b* are arranged so that one 64*a*, is positioned directly opposite a recess 20*c*, whereas the other 64*b* will be located in the section 32 between neighbouring recesses 20*a,b*. It will be apparent that in any rotational position one of the punch heads 34*a,b* will have its point 110*a,b* lying at a recess 20. Thus the communication tool 60 does not require to be orientated when it is run into the valve 34.

While FIG. 4(*b*) shows the punch heads 64*a,b* with one lying off the diameter of the tool 60, this is the arrangement wherein an equal number of recesses 20 are in the apparatus 10. The degree to which the punch head 64*a,b* sits off the diameter will be half the angular separation between neighbouring recesses 20*a,b*. If there are an odd number of recesses 20 then the punch heads 64*a,b* can be diagrammatically opposite, lying on the diameter of the tool 60. The diameter of the punch head 64*a,b* is greater than a diameter of the recess 20. Additionally, the recesses 20 will cover a distance around a circumference of the tool 60 which is greater than or equal to the distance covered by the sections 32 between the recesses 20.

With the punch housing 68 in position and sealed, via seals 120, to the inner surface of the valve 34, setting down weight on the tool 60 causes the first ends 80*a,b* of the pistons 70*a,b* to rise into the drive housing 66 as the drive housing 66 will come to rest on the first end 88 of the punch housing 68. Increasing fluid pressure in the wellbore will cause fluid to enter the drive housing 66 through ports 76*a-d* and pressure up the drive housing 66. This will force the pistons 70*a,b* downwards. The shear pins 104 will break, allowing movement of the pistons 70*a,b* through the punch housing 68. As the pistons 70*a,b* move downwards, the punch heads 64*a,b* in the tapered tracks 108, will by forced radially outwards, extending from the outer surface 114 of the punch housing 68. The punch head 64*b* which meets the section 32 of the apparatus 10, will be prevented from moving radially any further causing the piston 70*b*, to which it is held, to also be prevented from further movement. Meanwhile, the punch head 64*a* is driven into the recess 20*c* and the force will be sufficient to pierce and perforate the thin walled section 26 at the base 28 of the recess 20*c*. Accordingly a fluid pathway is created through the recess 20*c* to the annular chamber 12 which connects with the hydraulic fluid line at the fitting 46.

To remove the tool 60, the wireline is raised and with it the drive housing 68. The piston 70*a*, resting on the outlet 78*a*, will be pulled upwards causing the track 108*a* to pass under the punch head 64*a* and pull it radially inwards, out of the recess 20*c*. When outlet 78*b* reaches the mount 80*b* of piston 70*b*, this piston 70*b* will also be raised. When the ledges 100*a,b* contact the inlets 86*a,b* of the punch housing 68, the punch housing 68 is also raised and the tool 60 can be removed from the well.

If the tool 60 sticks in the valve 34, pressure in the wellbore is increased further to open the valve 118 in the shaft 116. In this arrangement, the valve 118 is initially held closed by shear pins rated at a higher value than those for the pistons 70*a,b*. Opening the valve 118 equalises pressure on either side of the tool 60 and allows the tool 60 to be pulled free. A jarring action can be used if required.

With the communication tool 60 removed a fluid communication line is left which allows fluid to pass between the throughbore 14 and the annular chamber 12 via the recess 20*c*. As the sections 32 between the neighbouring recesses 20*a,b* are of the same thickness as the tubular wall 18, the load bearing capacity of the main body 36 is not affected by the perforation of the thin walled section 26. A further tool such as an WRSV can now be inserted and connected to the valve 34, so as to operate from the fluid communication line to the annular chamber 12.

Reference is now made to FIG. 5 of the drawings which illustrates a punch head, suitable for use in the communication tool 60 of the present invention. Punch head 64 has a point 110 on a cylindrical body with a planar base 112 as described hereinbefore with reference to FIGS. 3(*a*) to (*d*). The point 110 forms a cone shaped cutting head 120. A section of the cone is removed to leave an elliptical face 122 with the cutting tip or point 110 now off-centre. In use, the point 110 can stab through the thin-walled section 26 at the base 28 of the recess 20 and the shape results in a disc of wall material being cut from the thin-walled section 26 which is folded to the side as the punch head 64 enters the recess 20. In this way, the cut section is folded into the recess and against a wall thereof so that it does not block the passageway through the perforated recess or create debris which could enter the annular chamber 12 and foul the control line fitting 46. This is made possible due to the thickness of the thin-walled section being able to be kept as thin as possible since it is supported by full thickness sections surrounding it which take the axial load.

To further assist in preventing debris fouling the passageway created through the recess 20, the annular chamber 12 and the hydraulic fitting 46, the control housing 38 as illustrated in FIG. 1(*b*) includes oppositely directed annular alcoves 124*a,b* between the recess 20 and fitting 46. These alcoves 124*a,b* allow debris to build-up therein which maintains a clear route between the fitting 46 and recess 20.

The principle advantage of the present invention is it provides apparatus for creating a fluid communication line in a downhole environment through a tubular wall between an annular chamber and a throughbore which maintains full axial load bearing capacity whilst also facilitating ease of perforation through the tubular wall.

A further advantage of the invention is that it provides an apparatus for creating a fluid communication line in a downhole environment through a tubular wall between an annular chamber and a throughbore in combination with a communication tool which creates a clear cylindrical passageway through the tubular wall.

It will be appreciated to those skilled in the art that various modifications may be made to the invention herein described without departing from the scope thereof. For example the subsurface safety valve may incorporate various types of valve closure elements. Additionally, even though subsurface safety valve has been shown as having hydraulic fluid acting directly upon the punch mechanism, it will be understood by one skilled in the art that the mechanism may alternatively incorporate a rod piston mechanism which is acted upon by a mechanical or hydraulic mechanism for actuation.

We claim:

1. Apparatus for creating a fluid communication line in a downhole environment between an annular chamber and a throughbore, the throughbore having a central longitudinal axis, there being a tubular wall between the annular chamber and the throughbore, and wherein the tubular wall is provided with a circumferentially arranged plurality of recesses, extending into the wall, the recesses are arranged equidistantly around the tubular wall and the recesses cover a distance around a circumference of the tubular wall which is greater than or equal to the distance covered by sections of the tubular wall between the recesses.

2. Apparatus according to claim 1 wherein the recesses extend from an outer surface of the annular wall so that they access the annular chamber.

3. Apparatus according to claim 1 wherein the recesses are cylindrical providing a circular disc of a first wall thickness at a base thereof with the tubular wall having a second wall thickness in which the recesses are formed, the second wall thickness being greater than the first wall thickness.

4. Apparatus according to claim 1 wherein the recesses are arranged radially from the central longitudinal axis and there are an even number of recesses.

5. Apparatus according to claim 1 wherein the tubular wall and recesses form part of the main body of a tubing retrievable safety valve.

6. Apparatus according to claim 5 wherein a control housing in the form of a sleeve is located over the main body so as to form the annular chamber and provide a control line connection.

7. A communication tool to create a fluid communication line in apparatus in a downhole environment, between an annular chamber and a throughbore of the apparatus, the throughbore having a central longitudinal axis, there being a tubular wall between the annular chamber and the throughbore, and wherein the tubular wall is provided with a circumferentially arranged plurality of recesses, extending into the tubular wall, the communication tool comprising a punch mechanism configured to radially extend a punch head so as to perforate the tubular wall between the annular chamber and the throughbore to provide the fluid communication, the communication tool being characterised in that: there are two punch heads, the punch heads being arranged to extend radially from the central longitudinal axis, in use, opposite each other with a first punch head aligned with a recess and a second punch head aligned with the tubular wall between two neighbouring recesses.

8. A communication tool according to claim 7 wherein the first punch head lies on a transverse axis perpendicular to the central longitudinal axis across a diameter of the throughbore and the second punch lies at an angle offset from the transverse axis, the angle being equal to half the radial separation between the recesses.

9. A communication tool according to claim 7 wherein the first and second punch heads are operated independently.

10. A communication tool according to claim 7 wherein the punch mechanism is hydraulically actuated.

11. A communication tool according to claim 7 wherein the punch mechanism is a piston mechanism, with two pistons, one associated with each punch head.

12. A communication tool according to claim 7 wherein includes retraction means to move the punch heads radially inwards when the communication tool is removed from the apparatus.

13. A communication tool according to claim 7 wherein each punch head has a conical section with a point to pierce the tubular wall at the recess.

14. A method for creating a fluid communication line in a downhole environment, comprising the steps:

(a) running a communication tool into apparatus located in a wellbore: the apparatus including an annular chamber and a throughbore, the throughbore having a central longitudinal axis, there being a tubular wall between the annular chamber and the throughbore, and wherein the tubular wall is provided with a circumferentially arranged plurality of recesses, extending into the tubular wall; and the communication tool comprising a punch mechanism configured to radially extend a punch head so as to perforate the tubular wall between the annular chamber and the throughbore to provide the fluid communication, the communication tool being characterised in that: there are two punch heads, the punch heads being arranged to extend radially from the central longitudinal axis, in use, opposite each other with a first punch head aligned with a recess and a second punch head aligned with the tubular wall between two neighbouring recesses;

(b) aligning the punch heads of the communication tool with the recesses of the apparatus so they are at the same depth;

(c) operating the punch mechanism so as to radially extend the punch heads; and (d) perforating the tubular wall at a recess to provide fluid communication through the tubular wall.

15. A method according to claim 14 wherein in step (b) a mating surface on the communication tool lands on a corresponding surface on a wall of the throughbore of the apparatus to stop the communication tool with the punch heads aligned with the recesses.

16. A method according to claim 14 wherein the apparatus is a tubing retrievable safety valve and the method includes the further step of running in a wireline retrievable safety valve into the tubing retrievable safety valve and operating the wireline retrievable safety valve via the communication line created at the perforated recess.

17. A method according to claim 14 wherein the communication tool is run-in on wireline.

18. A method according to claim 14 wherein, at step (c), the punch mechanism is operated by pumping fluid downhole.

* * * * *